US006217460B1

(12) United States Patent
Broadbridge et al.

(10) Patent No.: US 6,217,460 B1
(45) Date of Patent: Apr. 17, 2001

(54) PUTTER HAVING PLASTIC INSERT

(76) Inventors: John N. Broadbridge, 7 Pheasant La., Bridgewater, CT (US) 06752; Jeffery V. Broadbridge, 123 Cross Rd., Middlebury, CT (US) 06762; William E. Broadbridge, 87 Glenbrook Rd., Cheshire, CT (US) 06410

( * ) Notice: Subject to any disclaimer, the term of this patent is extended or adjusted under 35 U.S.C. 154(b) by 0 days.

(21) Appl. No.: 09/363,617

(22) Filed: Jul. 30, 1999

(51) Int. Cl.[7] ..... A63B 53/04

(52) U.S. Cl. ..... 473/324; 473/342; 473/409; 273/DIG. 11

(58) Field of Search ..... 473/409, 407, 473/342, 350, 330, 331, 324, 131, 235, 236, 349, 282, 340; 273/DIG. 11

(56) References Cited

U.S. PATENT DOCUMENTS 1,094,599 * 4/1914 Samson .
3,754,764 * 8/1973 Manheck .
4,872,684 * 10/1989 Dippel .
5,033,746 * 7/1991 Jones .
5,275,409 * 1/1994 Currie .
5,458,332 * 10/1995 Fisher .
5,688,190 * 11/1997 Rowland .
6,007,434 * 12/1999 Baker .

* cited by examiner

*Primary Examiner*—Sebastiano Passaniti
(74) *Attorney, Agent, or Firm*—Dallett Hoopes

(57) ABSTRACT

A process for modifying the face of a putter including the steps of milling out recess in a portion of the face, inserting a carrier strip coated on opposites with adhesive and inserting a plastic insert plate with the same dimensions as the recess. The insert plate is formed with an outward side having a group of closely spaced parallel V-shaped grooves running in one direction and another group of closely spaced parallel V-shaped grooves running in an intersecting direction, the grooves defining a plurality of pyramids having flat tops. The invention may also be described as a putter having such an insert and a plastic insert per se, described above.

10 Claims, 1 Drawing Sheet

PUTTER HAVING PLASTIC INSERT

FIELD OF THE INVENTION

This invention relates to golf putters. More specifically, this invention relates to a method for modifying a golf putter to insert a plastic putting face. The invention also relates to a putter having such a face. The invention relates to a plastic insert per se for a golf putter.

BACKGROUND OF THE INVENTION

The patent art is replete with golf putters of various shapes and attributes. The large majority of putters have flat metal faces. Occasionally hard metal inserts have been built into the face to provide for longer wear and a durable smooth flat surface which meets the ball.

In our experience we have detected a tendency of the ball to skid or wobble as it leaves the smooth metal putter face. Both the skid and wobble exacerbate the errant tendency of the ball leaving the putter when it has not been struck true. As a result, metal-faced putters are more apt to stray from the proper line between putter and cup.

An object of the present invention is to produce a putter having a plastic insert which reduces skid and wobble.

It is a further object to provide a putter having improved "feel", that is, a cushioned feel whether the golfer is using a balata ball or a surlyn-covered golf ball. By the same token, it is an object to prolong the contact between ball and putter face for more accurate control of the ball path.

SUMMARY OF THE INVENTION

The present invention is, of course, described in the claims. Briefly, however, the invention is a process for modifying the face of a putter including the steps of milling out a recess in the face, inserting into the rear surface of the recess a carrier strip coated on opposites with adhesive, and providing a plastic insert plate with the same dimensions as the recess. The rear face of the insert is formed with closely spaced parallel V-shaped grooves running in one direction and another group of closely spaced parallel V-shaped grooves running in an intersecting direction, the grooves defining a plurality of pyramids having flat tops. The invention may also be described as a putter having such an insert and as a plastic insert per se, described above.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
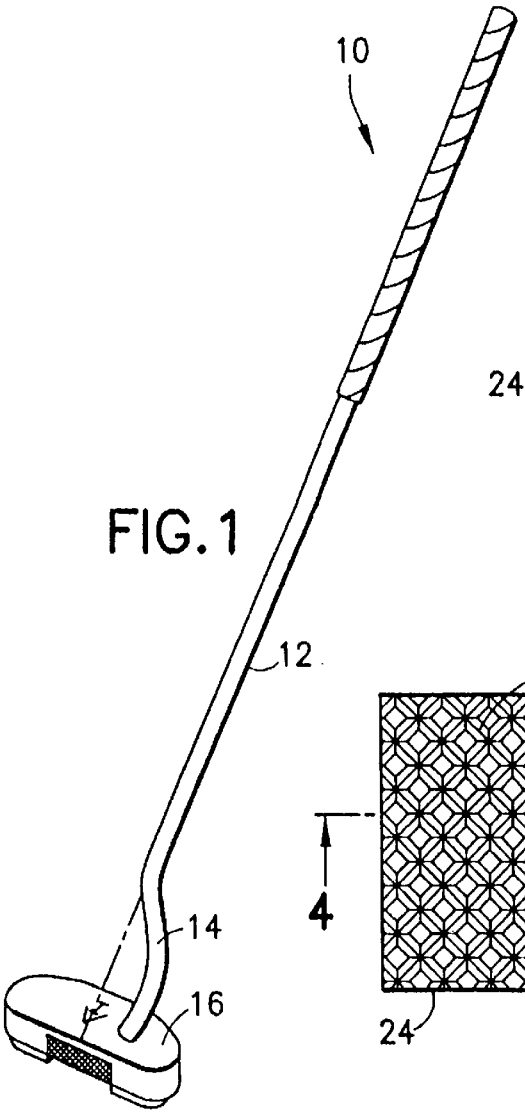
FIG. 1 is a perspective view of a putter embodying the invention.

A putter embodying the invention is shown in FIG. 1 and generally designated 10. It comprises a shaft 12 having a curved lower portion 14 joined to the head 16. It should be understood that the invention is not limited to any particular shape of the putter head or its shaft, but instead is applicable to putter heads having various shapes.

Figure 2:
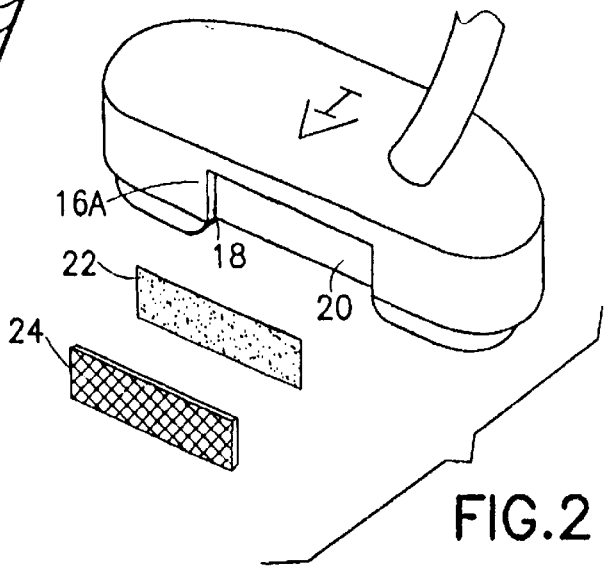
FIG. 2 is an exploded enlarged perspective view of the parts of the club head.
Figure 3:
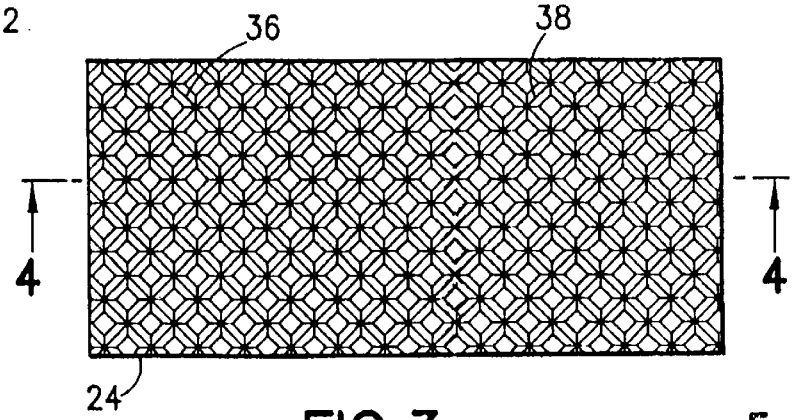
FIG. 3 is an enlarged elevational view of an insert embodying the invention.

As shown in FIG. 2, in the process of the invention, a central portion of the flat face of the putter is milled out to present a recess 18 having a rear surface 20 which is in a plane parallel to adjacent portions of the putter face.

Into the recess is pressed a carrier strip 22 which is covered on both sides by an adhesive. In the second step, the insert 24 is pressed onto the adhesive cover face of the carrier strip 22 to adhere the insert 24 onto the putter head.

The depth of the recess is preferably equal to the thickness of the adhesive carrier 22 and the insert 24 so that the forward face of the insert, after assembly, is flush with adjacent portions 16A of the putter face.

Figure 6:
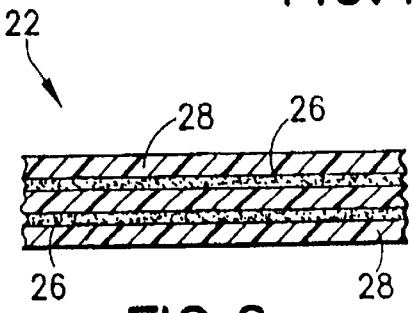
FIG. 6 is a fragmentary sectional view showing the adhesive carrier and its temporary peel strips on the opposite sides thereof.

More specifically, the carrier strip 22 (FIG. 6) comprises a polyester film which is available from Adchem under the product designation 256M double-coated polyester film. The adhesive 26 is preferably a high tack, moderate deadload acrylic adhesive film coating which, prior to use, is provided with a peel strip 28. Such peel strips are removed prior to assembly (FIG. 2).

Figure 5:
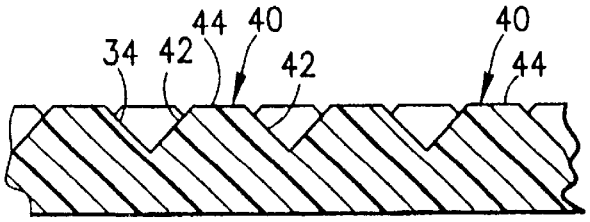
FIG. 5 is an enlarged fragmentary view of a portion of FIG. 4.

Referring now to the nature of the insert, it may be machined to the pattern shown, but preferably is molded. It comprises a plate having a thickness of 0.1" to 0.125" of an acetal plastic. As an example, the plastic may be Delrin, available in sheet form or as molding powder, from its manufacturer. The insert 24 may have a smooth side 30 and a grooved side 32. As shown in FIG. 5, the grooves 34 may be right angle grooves, that is, V-shaped grooves having vertex of approximately 90°. One group 36 of these groups extend in a given direction, while another group 38 extends in a intersecting direction with the intersection preferably being at 90°.

Figure 4:
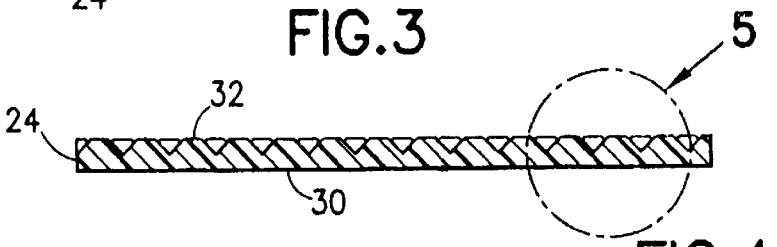
FIG. 4 is a sectional view taken on the line 4—4 of FIG. 3.

There is thus formed on the grooved face 32 of the insert 24 a pattern of 4-sided pyramids 40 (FIG. 5). Each of these pyramids has sides 42 at 45° to the outer surface plane of the insert. The pyramids are formed with flattened tops 44, the tops being all in a single plane, preferably parallel to the smooth plane 30 (FIG. 4). These flat square-shaped tops 44 are spaced by the grooves 36, 38 so that they provide resilience in each pyramidal shape. The square tops 44 are 0.030 inch on each side, and the spaces between adjacent tops are 0.050 inch. The spaced tops 44 present a cushioned ball-striking surface. This is because each top, unsupported laterally, is more yielding upon impact with the ball than they would be if the outer side 32 were smooth.

The result is that a putter embodying the invention gives longer contact between ball and putter face than the usual metal-faced putter in which the only resilient element is the ball cover itself. As a consequence, with the invention, using a regular surlyn ball gives the golfer the cushioned feel as if he were playing with a balata ball having a more resilient cover than a surlyn ball. Some golfers who prefer playing with balata balls have actually asked that the thickness of the insert be reduced to lessen the cushion effect. At present, the inserts are made of a Delrin plate of 0.105" thickness for balata ball users and 0.125" for surlyn ball users. The effects are virtually similar, that is, a cushioned feel at impact of the club on the ball.

As stated, using the putter head with the insert described reduces both the skid and wobble customary with metal-faced putters and provides improved feel and control with either a balata- or surlyn-covered golf ball.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A method for modifying the face of a golf putter head comprising the steps of:

a. providing a golf putter having a head with a flat face, b. milling out a portion of the face to define a recess having desired lateral dimensions and a rear surface, c. providing a carrier strip coated on opposite sides with an adhesive, d. pressing the carrier strip against the rear surface of the recess, e. providing a plastic insert plate of the same lateral dimensions as the recess and having an inward side and an outward side, the outward side being formed with a group of closely spaced parallel V-shaped grooves running in one direction and another group of closely spaced parallel V-shaped grooves running in another direction, intersecting the one direction, the two groups defining a plurality of pyramids having flat tops, and f. pressing the insert in the recess with the inward side against the coated carrier strip.

2. A method as claimed in claim 1 wherein the plastic is an acetal.

3. A method as claimed in claim 1 including the further steps of:

a. providing the carrier strip with peel strips over the adhesive coatings on opposite sides respectively, b. removing the peel strip on the inward side of the carrier strip prior to pressing the carrier strip against the floor of the recess, c. removing the peel strip on the outward side of the carrier strip prior to pressing the insert against the carrier strip.

4. A method as claimed in claim 1 wherein the carrier strip is of the same lateral dimension as the recess.

5. An insert for a recess in the face of a golf putter comprising a flat plate of plastic having an inward side and an outward side, the outward side being formed with a group of closely spaced parallel V-shaped grooves running in one direction and another group of closely spaced parallel V-shaped grooves running in another direction intersecting the one direction, the two groups defining on the outward side a plurality of pyramids having flat tops.

6. An insert as claimed in claim 5 wherein the plastic is an acetal.

7. An insert as claimed in claim 5 wherein the one direction is perpendicular to the other direction.

8. An insert as claimed in claim 5 wherein the grooves each have sides intersecting at 90°.

9. An insert as claimed in claim 5 wherein the flat tops are square and measure about 0.030" on a side and about 0.050 inch between tops.

10. A golf putter having an insert as described in claim 5.

* * * * *